US005434603A

United States Patent [19]

Hunt

[11] Patent Number: 5,434,603

[45] Date of Patent: Jul. 18, 1995

[54] INK CARTRIDGE WITH PASSAGEWAY FOR INK LEVEL INDICATOR

[75] Inventor: David S. Hunt, San Diego, Calif.

[73] Assignee: Hewlett-Packard Company, Palo Alto, Calif.

[21] Appl. No.: 995,108

[22] Filed: Dec. 22, 1992

Related U.S. Application Data

[63] Continuation-in-part of Ser. No. 717,735, Jun. 19, 1991, Pat. No. 5,359,353.

[51] Int. Cl.[6] ..... B41J 2/195

[52] U.S. Cl. ..... 347/7; 347/87; 73/290 R; 222/23

[58] Field of Search ..... 346/140 R; 222/23, 41, 222/45; 73/290 R; 116/227, 278, 281; 347/7, 86, 87

[56] References Cited

U.S. PATENT DOCUMENTS

| | | | |
|---|---|---|---|
| 4,016,885 | 4/1977 | Bruner | 347/7 |
| 4,196,625 | 4/1980 | Kern | 73/304 C |
| 4,415,886 | 11/1983 | Kyogoku et al. | 73/304 C |
| 4,422,084 | 12/1983 | Saito | 347/7 |
| 4,935,751 | 6/1990 | Hamlin | 347/7 X |
| 5,079,570 | 1/1992 | Mohr et al. | 347/7 |
| 5,152,427 | 10/1992 | Pope et al. | 222/23 |

FOREIGN PATENT DOCUMENTS

| | | | |
|---|---|---|---|
| 62-204951 | 9/1987 | Japan | 347/7 |
| 63-3957 | 1/1988 | Japan | 347/7 |

*Primary Examiner*—Benjamin R. Fuller
*Assistant Examiner*—J. Barlow
*Attorney, Agent, or Firm*—David S. Romney; Dennis G. Stenstrom

[57] ABSTRACT

An ink jet pen supply cartridge having a spring biased ink reservoir with a visual indication of remaining ink quantity. The reservoir tends to collapse laterally as the ink supply decreases due to differential pressure exerted thereto. The spring-reservoir is contained in a rigid cartridge and a pair of flexible tape members are cemented or welded, one to each side of the spring-reservoir, and extend generally parallel toward a narrow end surface of the cartridge at which they overlap and can be viewed through a window. The overlapping relationship of the tape members provide ink quantity indicia which change as the spring-reservoir collapse draws them past each other.

6 Claims, 10 Drawing Sheets

INK CARTRIDGE WITH PASSAGEWAY FOR INK LEVEL INDICATOR

CROSS REFERENCE TO RELATED APPLICATIONS

This application is a continuation-in-part of application SPRING-BAG PRINTER INK CARTRIDGE WITH VOLUME INDICATOR, David S. Hunt, Ser. No. 07/717,735, filed Jun. 19, 1991, U.S. Pat. No. 5,359,353.

FIELD OF THE INVENTION

The invention relates generally to ink reservoirs for high speed ink printers such as color business printers and, more specifically, to residual ink volume indicators for ink reservoirs.

BACKGROUND OF THE INVENTION

The problem of monitoring ink level in all types of high speed printers such as ink-jet printers with ink reservoirs has been variously addressed. So-called back pressure indicators require a plurality of complex seals within the pen cartridge assembly and are therefore relatively expensive and tend to be unreliable. Other ink volume indicators rely on measurement of ink bulk conductivity. The conductivity of the ink is difficult to control and there is the likelihood that future ink improvements could make such a system obsolete.

There have also been attempts to count the "dots" or drops from a given pen. The counters, actuators and sensors needed for such systems make them relatively expensive. Furthermore, accuracy is compromised by the need to assume an average drop volume for all pens. Interruptions such as caused by removal of a pen/cartridge assembly or shut-down of the printer are a further source of unreliability since the record of the number of drops fired from the ink jet since the last update is likely to be lost.

Prior art known to applicants comprises U.S. Pat. Nos. 4,196,625; 4,202,267; 4,371,790; 4,415,886; 4,551,734; 4,587,535; 4,626,874; 4,719,475; and 4,935,751; and pending application Ser. No. 07/423,158 filed Oct. 18, 1989 in the names of John Mohr, et al for a CAPILLARY RESERVOIR INK LEVEL SENSOR and now owned by the assignee of the present invention.

With the exception of U.S. Pat. No. 4,935,751 which is discussed below, and U.S. Pat. No. 4,587,535 which discloses a system of the pressure sensing type, all of the above patents describe monitoring systems which rely on measurement or detection of ink conductivity.

U.S. Pat. No. 4,935,751, owned by the assignee of the present invention, discloses a mechanical level sensor for an ink bag which employs a rigid plate secured to one side of a collapsible ink bag wherein one end of the strip is visible through a window in the ink bag housing. Although the position of the edge of the indicator strip is indicative of the remaining amount of ink in the bag, an "empty" indication appears although an amount of useable ink remains in the bag.

Also of interest are prior co-pending U.S. patent applications Ser. No. 07/929,615 filed Aug. 12, 1992 by Kaplinsky, et. al entitled COLLAPSIBLE INK RESERVOIR STRUCTURE AND PRINTER INK CARTRIDGE and Ser. No. 07/928,811 filed Aug. 11, 1992 by Khodapanah, et. al entitled INK PRESSURE REGULATOR FOR A THERMAL INK-JET PRINTER, both owned by the assignee of the present application.

Further developments of this collapsible bag technology are disclosed in the U.S. patent applications filed on the same day as this application titled METAL COVER ATTACHMENT TECHNIQUE FOR THERMAL INKJET PEN by inventors Dale D. Timm, Jr., et. al Ser. No. 07/994,810; RIGID LOOP CASE STRUCTURE FOR THERMAL INK-JET PEN by inventors David W. Swanson, et. al Ser. No. 07/994,808; and TWO MATERIAL FRAME HAVING DISSIMILAR PROPERTIES FOR THERMAL INK-JET CARTRIDGE by inventors David W. Swanson, et. al Ser. No. 07/994,807 all owned by the assignee of the present invention.

None of the foregoing references provides a simple and inexpensive ink volume indicator. In fact, even if the enclosure is transparent, visual observation of ink in a collapsible ink bag reservoir is not reliable since the collapse of the reservoir as ink is used does not produce direct level change although volume change is, of course, occurring.

One example of an improved ink volume indicator is disclosed in U.S. patent application Ser. No. 07/717,735, filed Jun. 19, 1991, U.S. Pat. No. 5,539,353, entitled SPRING-BAG PRINTER INK CARTRIDGE WITH VOLUME INDICATOR filed by David S. Hunt and W. Bruce Reid and assigned to the assignee of the present invention. The cartridge disclosed in that application basically comprises a rectangular housing containing a flexible bag of ink, an ink filter and a print head which receives ink from the filter. A spring inside of the bag of ink urges its flexible walls apart from each other thus maintaining a negative or sub-atmospheric pressure in the reservoir which is overcome as ink is emitted from the print head. The manner in which the invention advances the state of the art in respect to ink volume monitoring in a collapsible reservoir assembly will be evident from the following description of the invention.

SUMMARY OF THE INVENTION

An ink cartridge with an ink supply reservoir comprising an external case member; an internal ink reservoir having a movable portion which moves from a first position when said reservoir is full through an intermediate position when said reservoir is partially empty to a third position when said reservoir is substantially empty; tab means attached at one end to said movable portion of said internal ink reservoir, for indicating the change in amount of ink in said ink reservoir; and guide means attached to said external case member for defining a passageway to receive said tab means, said guide means including a top surface for displaying visual indicia and a bottom surface for completely overlying said tab means.

DETAILED DESCRIPTION OF THE PREFERRED EMBODIMENT

Figure 1:
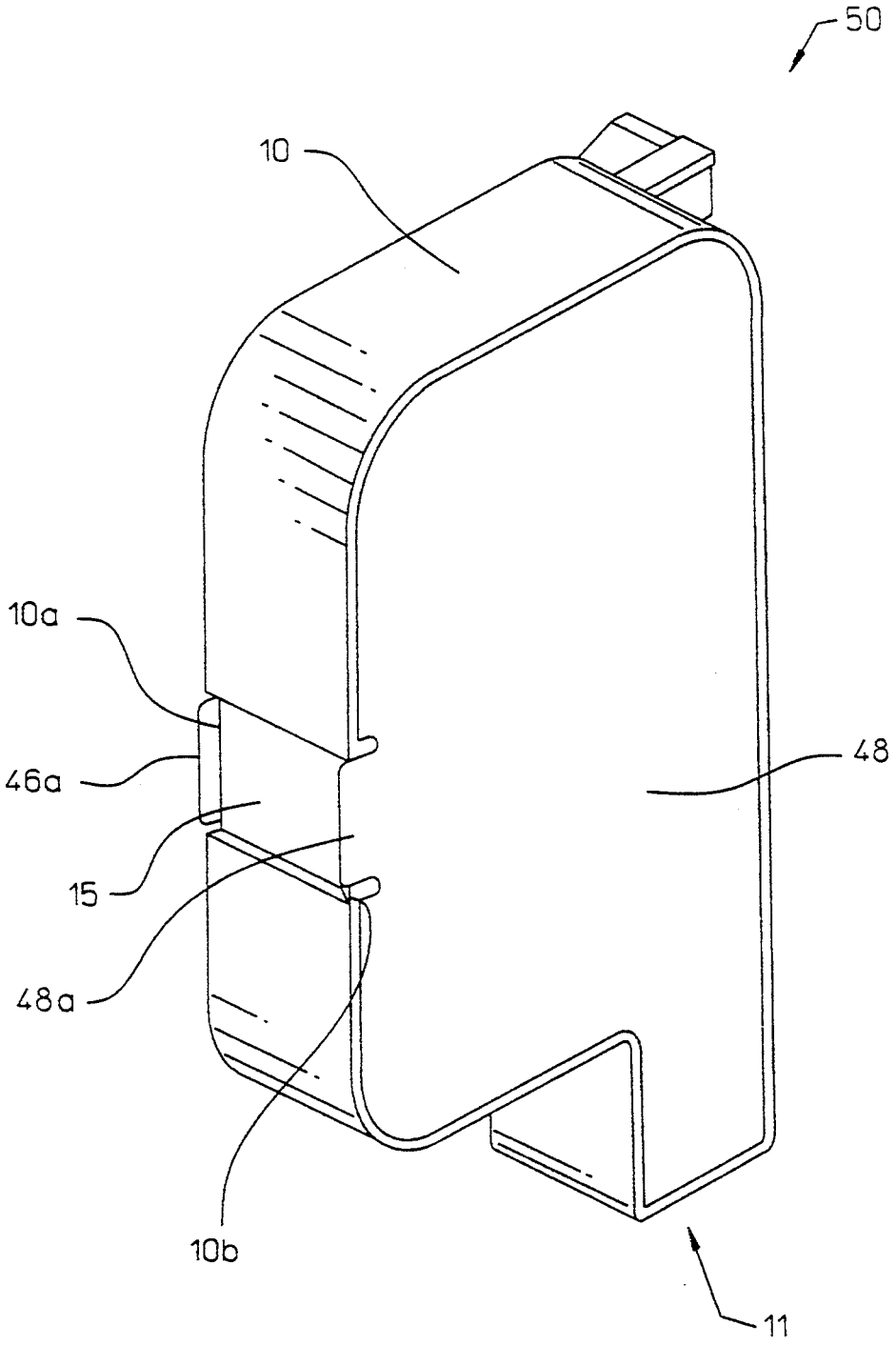
FIG. 1 is a perspective view of the ink cartridge assembly of the present invention.

Referring to FIG. 1, an ink cartridge 50 is depicted for enclosing a spring biased collapsible ink reservoir. This ink cartridge is usually made of opaque material such as plastic or metal and is comprised of an outer peripheral frame 10 and a pair of parallel opposed cover plates 46 (not shown) and 48 which are affixed to the outer peripheral frame 10 by welding, gluing or press fitting after installation of the internal components. A preferred method of affixing cover plates 46 (not shown), 48 to outer peripheral frame 10 is described in an U.S. patent application filed on the same day as this application entitled METAL COVER ATTACHMENT TECHNIQUE FOR THERMAL INK-JET PEN, by inventors Dale D. Timm, et. al, U.S. Ser. No. 07/994,810, filed Dec. 22, 1992, which is herein incorporated by reference. The snout portion 11 of the ink cartridge 50 has an ink discharge aperture 12 (not shown) in its end portion (at the bottom in FIG. 1) to which is affixed an electrically driven print head (not shown).

Figure 2:
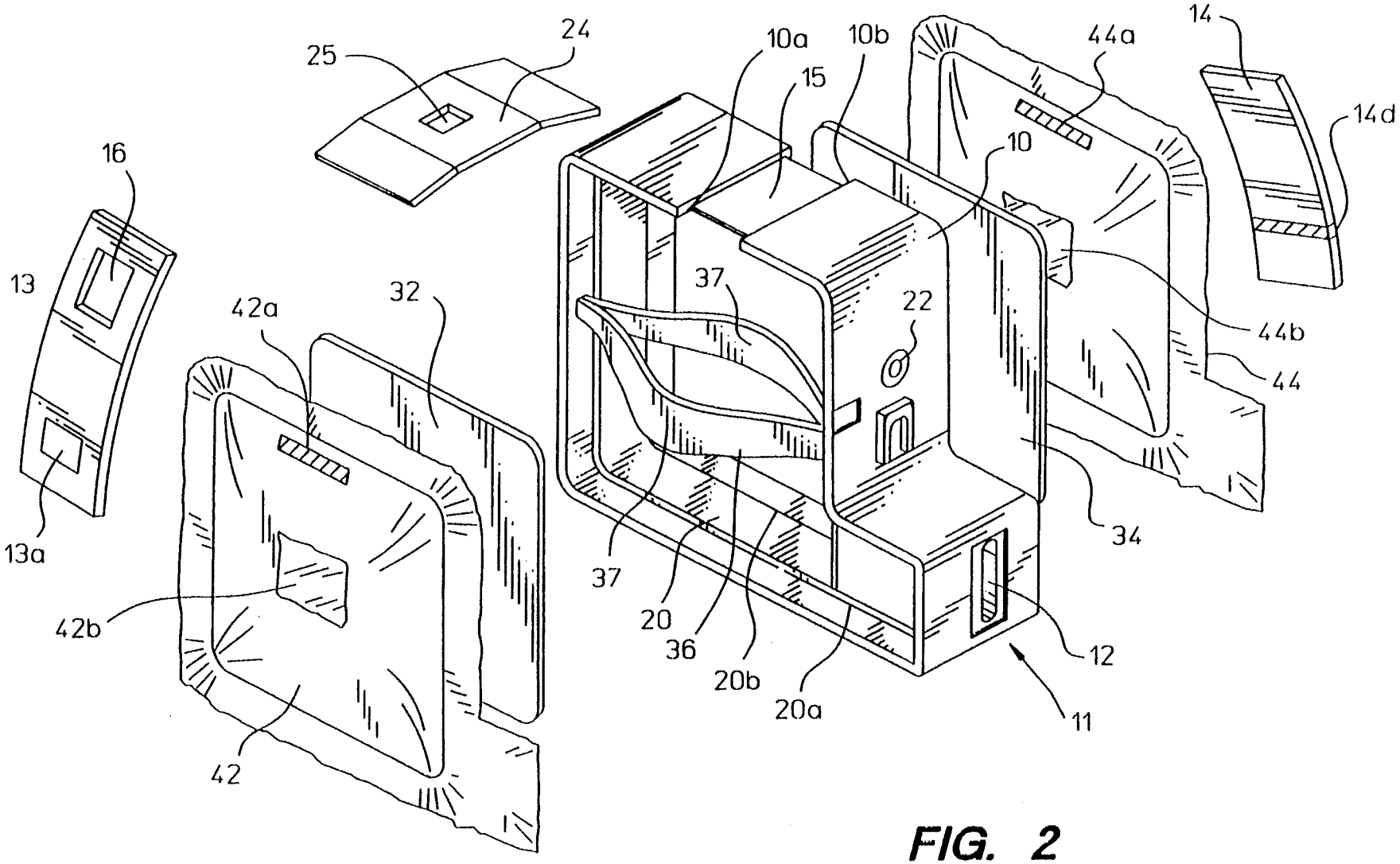
FIG. 2 is an exploded view of the ink cartridge and reservoir assembly and ink level indicating elements.

Referring to FIG. 2, the sidewalls of the reservoir are identified at 42, 44. A collapsible reservoir system comprised of a relatively rigid inner peripheral frame 20 and a pair of ink reservoir sidewalls 42, 44 at least one of which is flexible material attached thereto is mounted in outer peripheral frame 10. Preferably, inner peripheral frame 20 is molded with the outer peripheral frame 10 in a two step injection molding process. Preferably inner peripheral frame 20 is formed of a softer and lower melting point plastic than the plastic of outer peripheral frame 10 to permit heat bonding of the reservoir sidewalls 42, 44 thereto along the side edges 20*a*, 20*b* of inner peripheral frame 20. Alternatively, inner frame 20 may be separately constructed with some flexibility to assist in mounting it in the peripheral frame 10, but the frame 20 is rigid relative to the flexible ink reservoir sidewalls described below. The inner peripheral frame 20 has a pair of opposite side edges 20*a*, 20*b* to which the flexible ink reservoir sidewalls 42, 44 are respectively joined as by heat welding at their peripheral edges to form the external reservoir structure. A preferred method of constructing inner and outer peripheral frames 20, 10 is described in an United States patent application filed on the same day as this application entitled TWO MATERIAL FRAME HAVING DISSIMILAR PROPERTIES FOR THERMAL INK-JET CARTRIDGE by inventors David W. Swanson, et. al, U.S. Ser. No. 07/994,807, filed Dec. 22, 1992), which is herein incorporated by reference.

Figure 3:
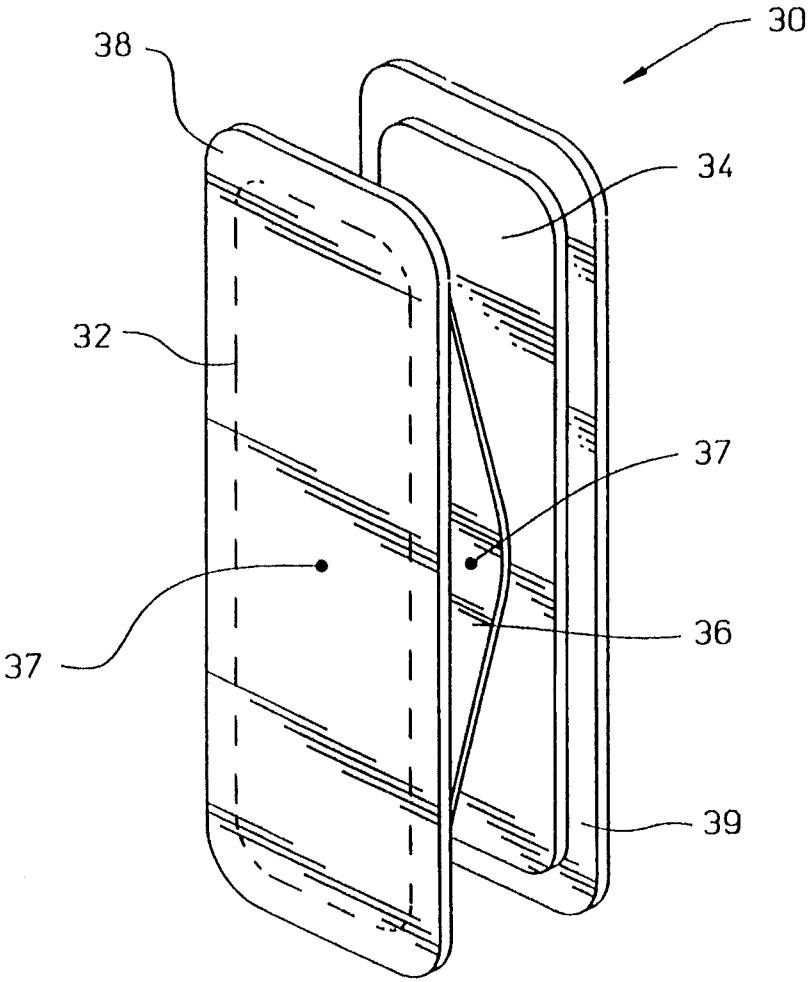
FIG. 3 is a perspective view of the pressure regulator assembly.

FIG. 3 shows the pressure regulator 30 assembly. The pressure regulator sideplates 32, 34 may be individually cut from a continuous strip of metal such as stainless steel, each plate being of generally rectangular configuration with rounded corners to minimize damaging the flexible reservoir sidewalls. The bow springs 36 also may conveniently be cut from a common strip of metal such as stainless steel. The bow spring 36 may be affixed, preferably by spot or laser welding at the apexes of each of its bights 37 centrally onto each of the sideplates 32, 34. An optional protective bonded layer in the form of a thin, but tough polyethylene cover layer 38, 39 having an acrylic adhesive on one surface thereof is press bonded to the outer surface of each side plate 32, 34. The cover layers 38, 39 are each sized slightly larger than the side plates 32, 34 so that a marginal width of a few millimeters of the cover layers extends beyond each edge of the metal plates 32, 34 to prevent those edges from contacting the comparatively delicate reservoir wall sidewalls 42, 44.

The pressure regulator 30 is centrally positioned in the inner peripheral frame 20 and the two flexible ink reservoir sidewalls or 42, 44 are then heat bonded or cemented at their peripheral edges to the outer edge walls 20*a*, 20*b* of the inner peripheral frame 20, respectively, with care being taken to maintain the central positioning at all time of the regulator 30 in inner peripheral frame 20 between the flexible sidewalls 42, 44. The reservoir sidewalls 42, 44 may then be securely affixed to the pressure regulator 30 sideplates 32, 34 preferably by heat bonding the reservoir sidewalls 42, 44 to the sideplates 32. 34 or to the cover layers 41, 51 if present in the area shown as 42*b*, 44*b* in FIG. 2. This heat sealing has the primary purpose of preventing relative motion between the pressure regulator 30 and preventing direct contact of the metal sideplates 32, 34 with the relatively delicate reservoir sidewalls 42, 44 to prevent the edges of the sideplates from cutting or puncturing the sidewalls. The cover plates 46, 48 are then affixed to the outer peripheral frame 10 as described above. A preferred method of constructing ink cartridge 50 is described in an United States patent application filed on the same day as this application entitled RIGID LOOP CASE STRUCTURE FOR THERMAL INK-JET PEN by inventors David W. Swanson, et. al U.S. Ser. No. 07/994,808, filed Dec. 22, 1992, which is herein incorporated by reference.

The material used for reservoir sidewalls 42, 44 should be flexible, relatively puncture resistant, impermeable to moisture and chemically compatible and nonreactive with the ink contained therein to prevent leakage or migration of the ink out of the reservoir, and impermeable to external contaminants such as air, dust, liquids and the like.

The reservoir is filled with ink via port 22 which is subsequently plugged for shipment. The required means which fire the ink droplets through the orifices 12 is conventional and causes progressive collapse of the spring reservoir such that its sidewalls 42, 44 retreat equal distances inwardly in the peripheral frame as the ink volume is decreased.

Figure 4:
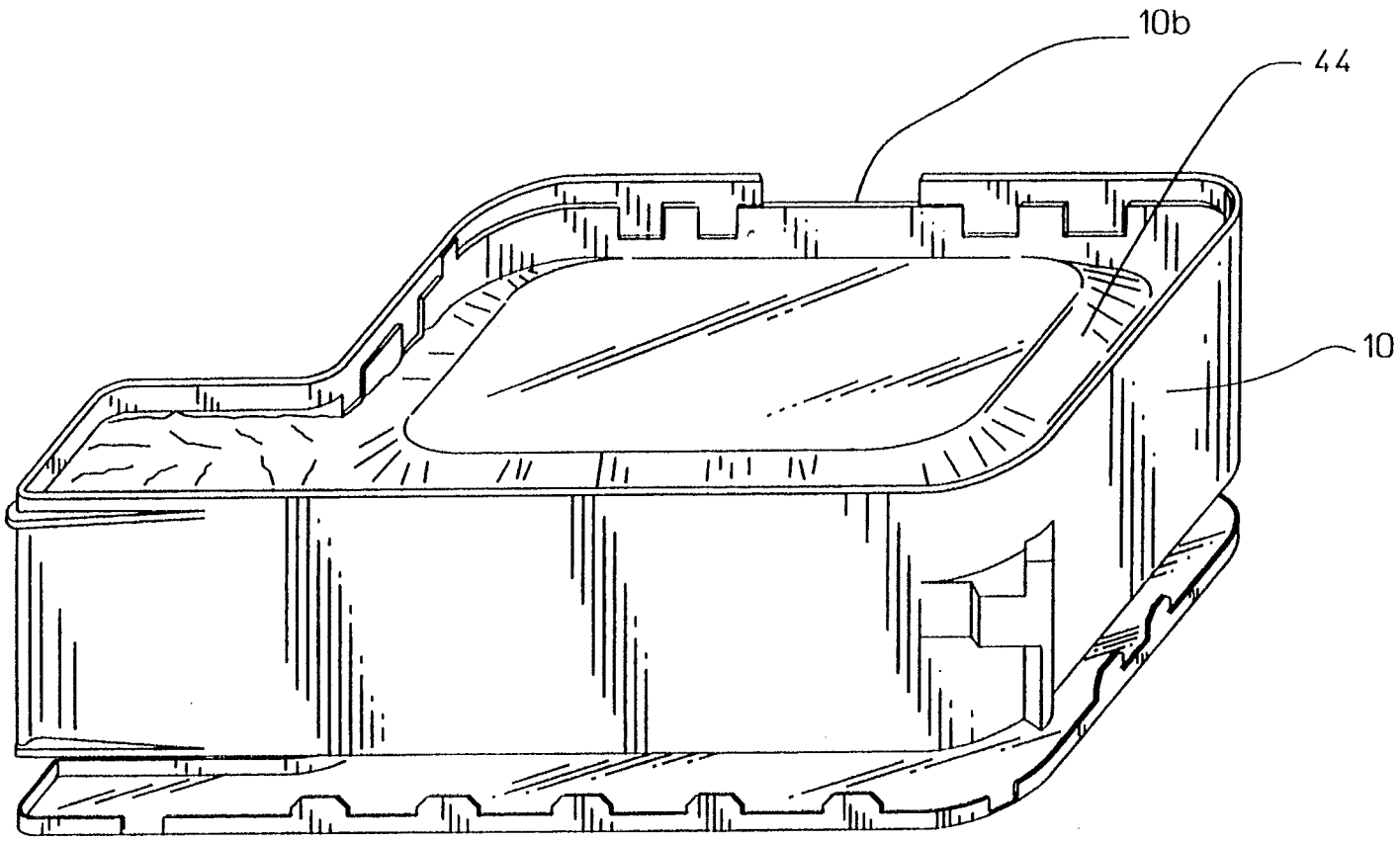
FIG. 4 is a perspective view of ink cartridge with cover plates removed to show slot in the outer peripheral frame.
Figure 5:
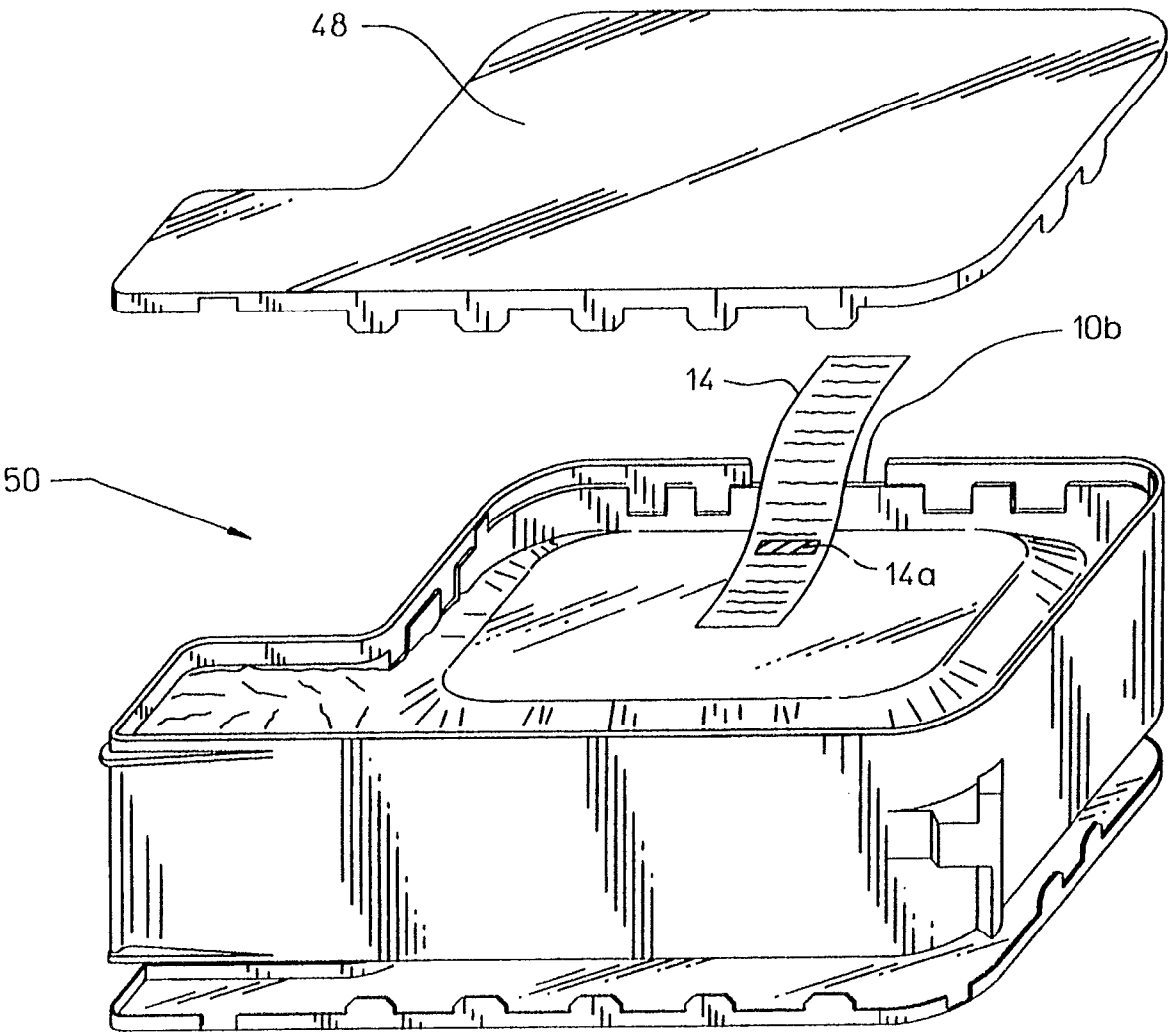
FIG. 5 is a perspective view of ink cartridge with cover plate removed to show indicator strip passing through the slot in the outer peripheral frame.
Figure 6:
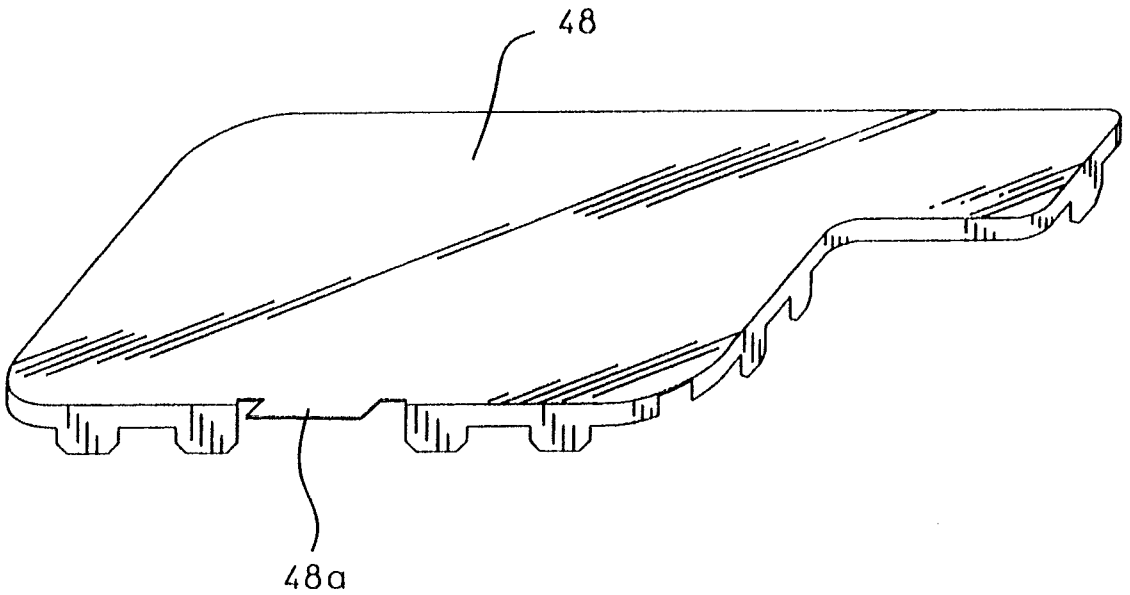
FIG. 6 is a perspective view of the cover plate showing tab extensions.
Figure 7:
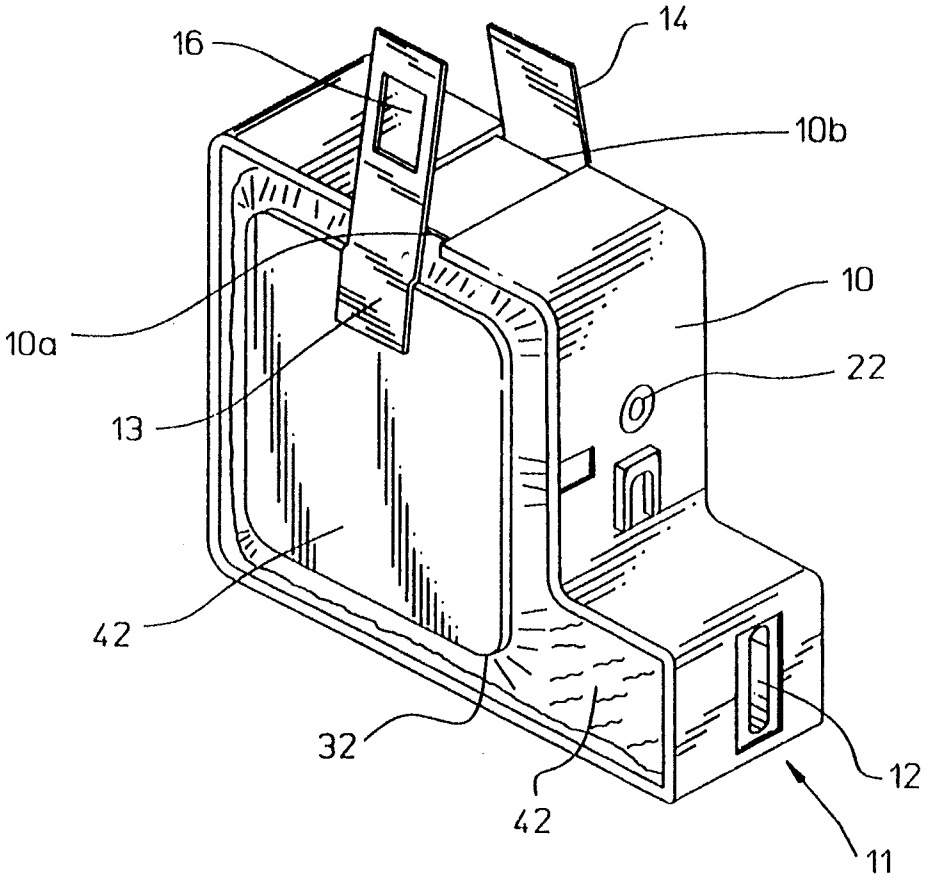
FIG. 7 is a perspective view of the ink cartridge assembly and ink level indicator device with the cover plate removed.
Figure 8:
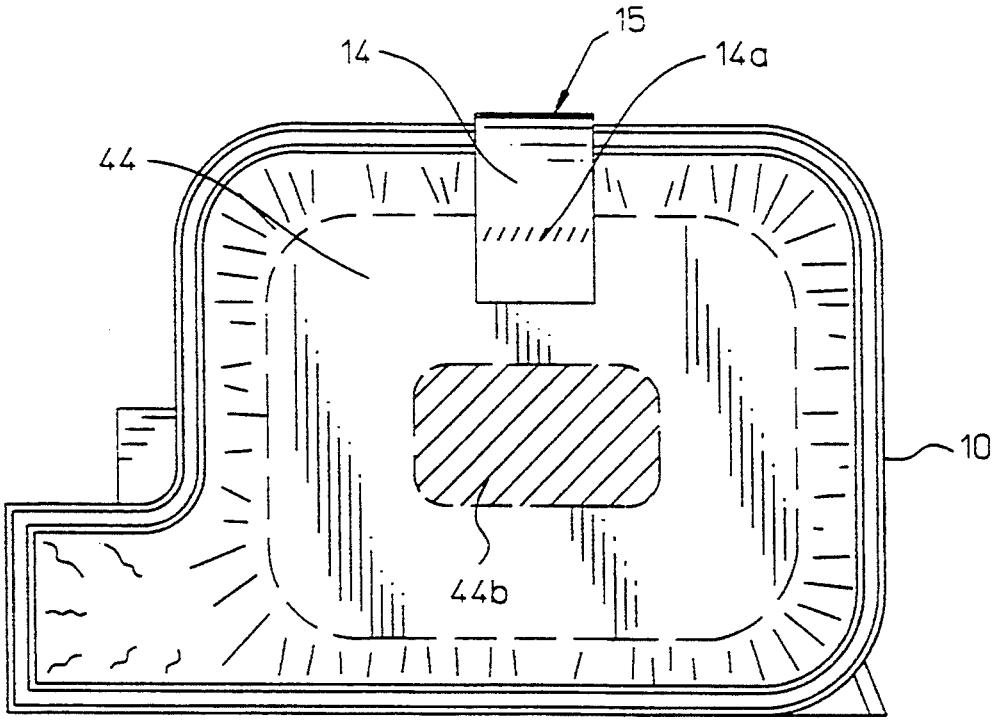
FIG. 8 is a side view of the ink cartridge without the outer cover plate.

Referring to FIGS. 1, 2 and 4, peripheral outer frame 10 is provided with a pair of spaced parallel slots 10*a* and 10*b* on opposite sides of reduced thickness channel 15. Cover plates 46, 48 provide tab extensions 46*a*, 48*b*, respectively, as shown in FIGS. 1 and 6. Tabs 46*a* and 48*a* align with slots 10*a*, 10*b*, respectively, to provide a passageway for thin indicator strips 13 and 14 which are cemented or heated sealed to opposite reservoir sidewalls 42, 44, respectively. The sealed areas of indicator strip 13, 14 and sidewalls 42, 44 are shown as areas 13*a*, 14*a* and 42*a*, 44*a*, respectively, in FIGS. 2, 5 and 8. Referring to FIGS. 5, 7 and 8, indicator strips 13, 14 pass between tabs 46*a*, 48*a* and slots 10*a*, 10*b* and fold over each other into reduced channel 15. Indicator strip 14 is the lower or inside indicator strip having a color (e.g., green) which provides an indicia visible through a window 16 in indicator strip 13 when the indicator strips 13, 14 are in place. Indicator strip 13 is preferably of the same color (e.g., black) as the peripheral frame material. Reduced thickness channel 15 in peripheral outer frame 10 receives the overlying indicator strips 13 and 14. A window device 24 having a stationary viewing window 25 therein is placed over and aligned with the reduced thickness channel 15 to provide a passageway for movement of the indicator strips 13, 14. The movement of the window 16 in indicator strip 13 permits visual observation of the movement of indicator strip 13 and of the contrasting color (e.g., green) indicator strip 14.

Figure 11A:
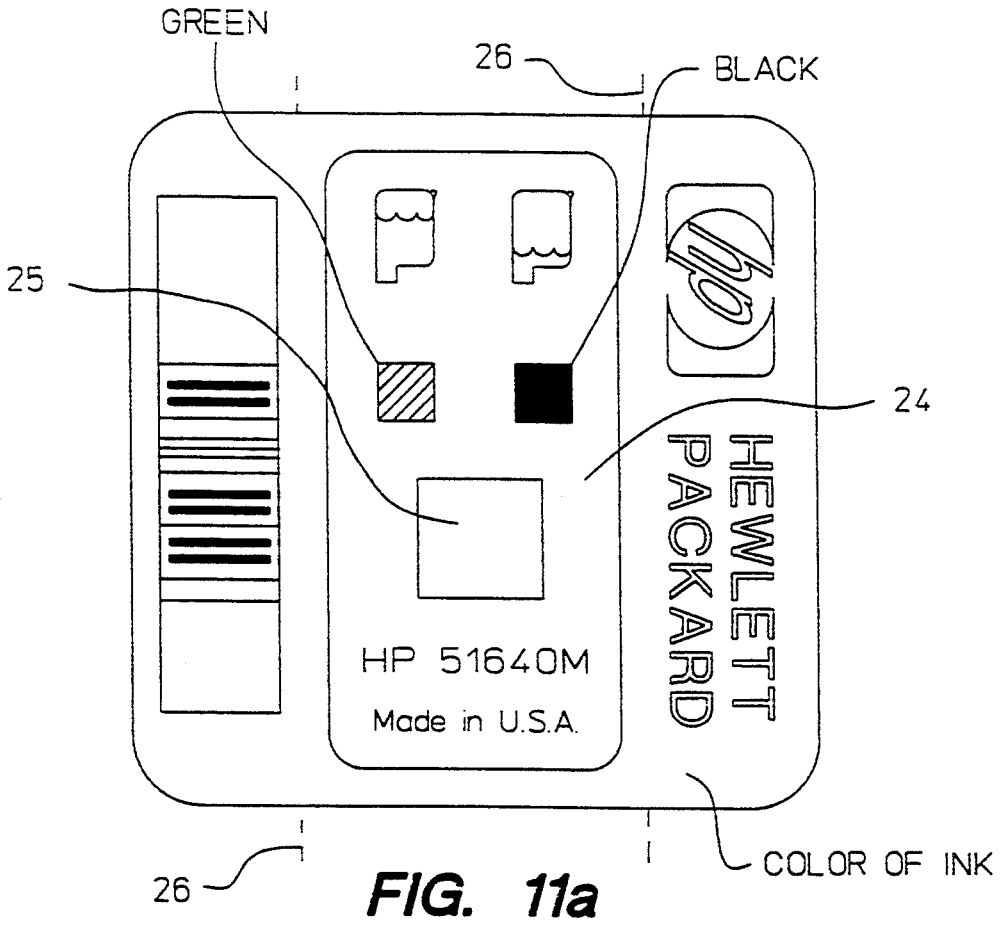
FIGS. 11*a* and 11*b* are a top view of the front and back of the window device of the present invention.
Figure 11B:
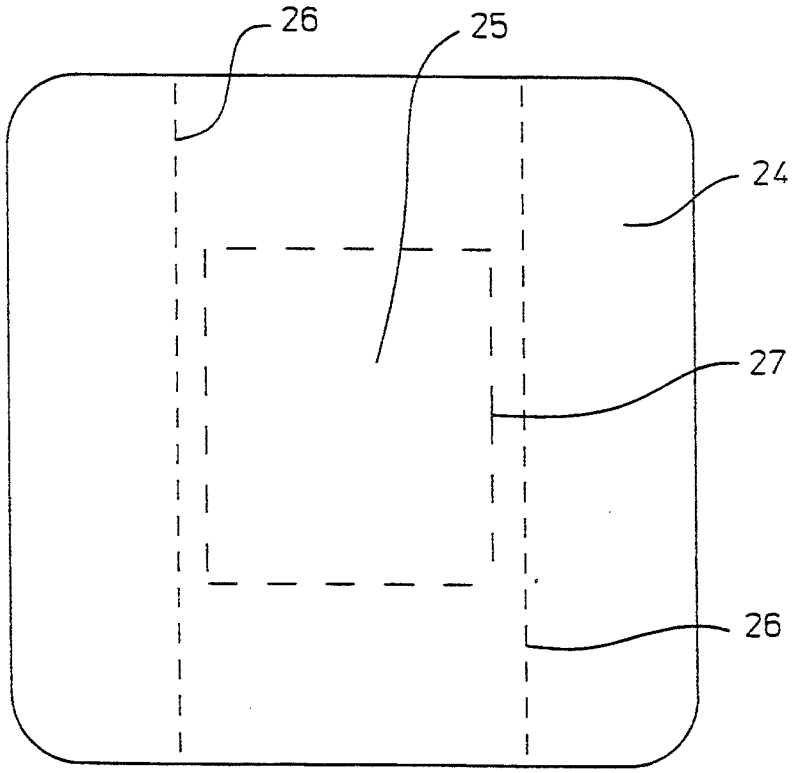

The indicator strips 13, 14 move directly below the window 25 in window device 24, therefore, the back of the window device 24 that is in contact with the indicator strips 13, 14 must not inhibit this motion. The window device 24 is attached to the pen body with adhesive which would inhibit the motion of indicator strips 13, 14. Referring to FIG. 11*a* and 11*b*, to solve this problem the window device 24 has a unique backside die cut 27 shown in FIG. 11*b* that allows a selected portion of the liner to remain attached to the window device 24 when it is dispensed and applied to the pen body. The backside of the liner can also be treated with a release coating to further prevent sticking. The wrapping of the window device 24 over indicator strips 13, 14 and reduced channel area 15 and down the sides of cover plates 46, 48 is facilitated by perforations 26 in the window device 24 along the line where window device 24 wraps over tabs 46*a*, 48*a* and down the face of cover plates 46, 48.

Figure 12:
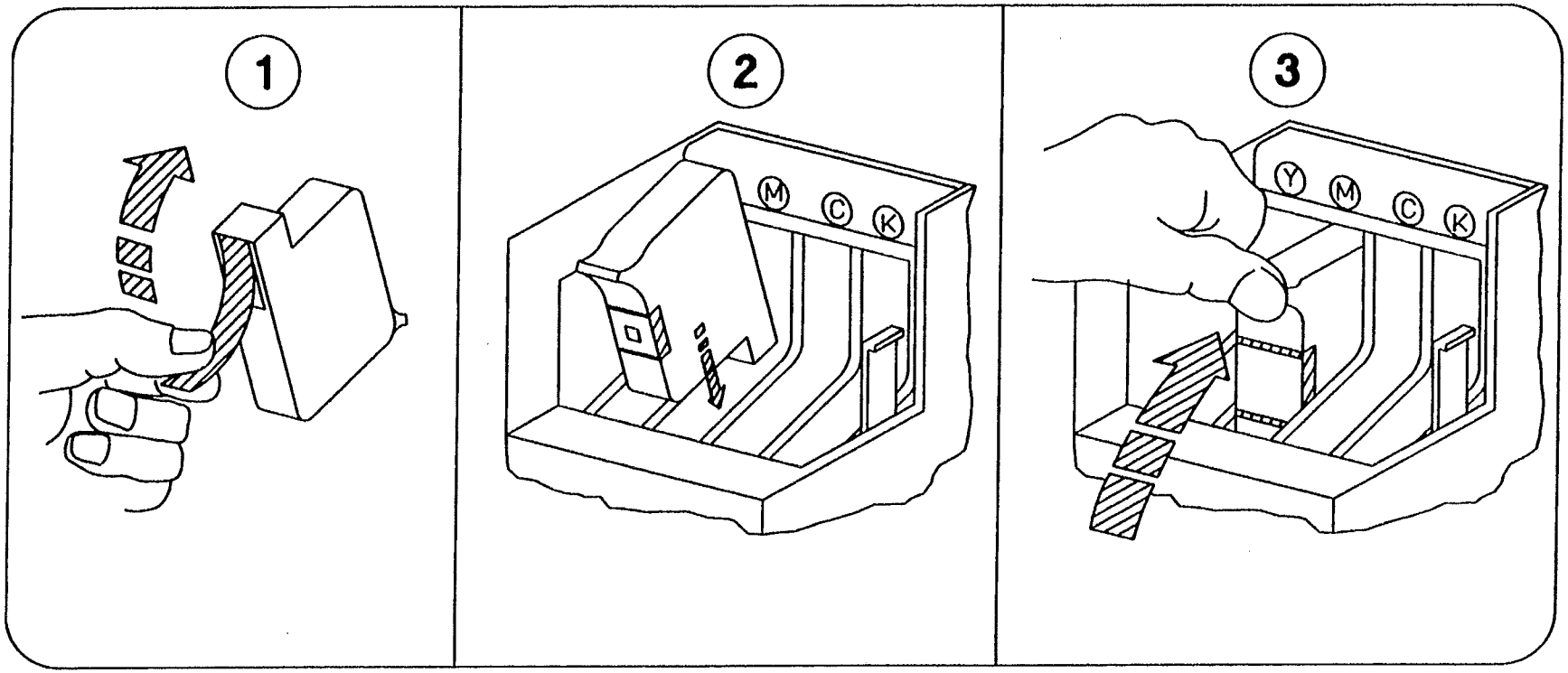
FIG. 12 is a simplified perspective view of the installation of the ink cartridge of the present invention.

The window device 24 may optionally function as a label and include information for educating the customer as to the meaning of the ink level indicating system, the color of ink, the part number, the country of origin and the company that manufactures the ink cartridge. A barcode on the label would solve the problem of identifying which ink color and printer the cartridge has been made for in order for the packaging equipment to place the cartridge in the correct package. FIG. 12 shows the ink cartridge mounted in a printer cartridge to show that window device 24 and the ink level indicator band are visible when the cartridge 50 is installed in the printer.

Figure 9:
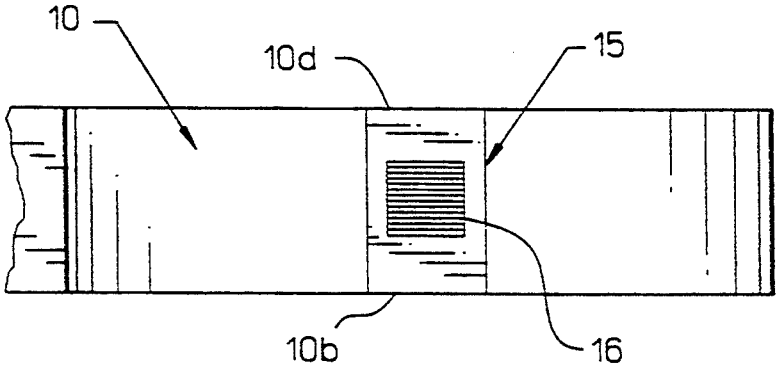
FIG. 9 is a top view of FIG. 8 showing a window in an overlaying film strip and indicia on an underlying strip indicating the condition of nearly full ink supply.
Figure 10:
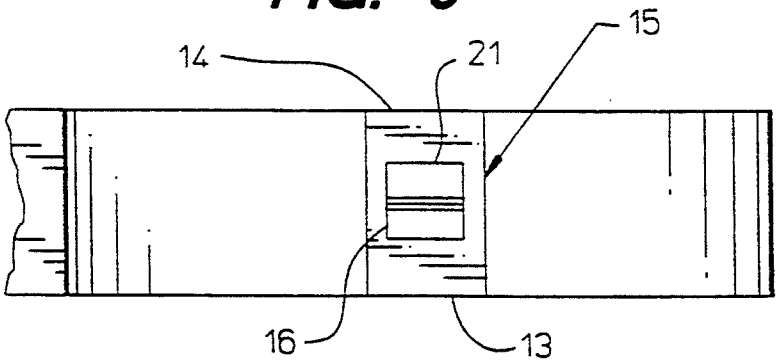
FIG. 10 is a top view of FIG. 8 showing the window in the overlying film strip and the indicia on the underlying film strip indicating the condition of nearly depleted ink supply.

Referring now to FIGS. 9 and 10. FIG. 9 shows a substantially full condition indication (all green) whereas FIG. 10 shows the indicator appearance when the ink supply is nearly exhausted and a narrow band of green appears in stationary window 25 with the remainder of the window 25 appearing as black. When the ink supply is further exhausted, the narrow band of green will diminish until stationary window 25 appears all black. This appearance of from all green, to a gradually narrowing band of green and finally to all black is caused by the viewer seeing black from the black peripheral frame gradually beginning to appear from the left (due to the rightwardly retreating edge of green indicator strip 14) and from the right (due to the leftwardly moving black right edge of window 16 in indicator strip 13). This appearance is obtained when the peripheral frame 10 is the same color (black) as the indicator strip 13 but it will be appreciated that other color combinations or types of indicia may be chosen within the spirit of the invention. The action of spring 36 ordinarily can be expected to keep the collapsible reservoir centered in the peripheral frame so that the narrowing indicator band of green in window is kept centered therein, although such centering is not essential.

From the foregoing, it will be realized that, as the ink supply decreases, reservoir sidewalls 42, 44 retreat inwardly and the indicator strips 13 and 14, passed through slots 10*a* and 10*b* in the reduced thickness portion of peripheral outer frame 10 and folded over the side edges thereof, are pulled apart from each other to progressively expose the contrasting color (black) of the peripheral frame and overlying indicator strip 13 through the stationary window 25 in window device 24.

The relative movement of the indicator strips 13 and 14 is substantially independent, even if reservoir sidewalls 42, 44 do not collapse inwardly by the same amount. The stationary window 25 allows for some variation in reservoir collapse between sidewalls 42, 44.

One skilled in the art will realize that variations of the disclosed structure within the spirit of the invention are possible and accordingly it is not intended that the scope of the invention should be considered limited to the specifics of the drawings or this description, these being typical and illustrative only.

One variation could involve a one sided indicator strip attachment with a window such as 16 working against indicia inscribed on the reduced thickness portion of peripheral outer frame 10. Such a variation would be less accurate than the disclosed double indicator strip arrangement unless a spring-reservoir were developed with one fixed side so that all collapsing motion would occur in the other side.

As a further development, optical or magnetic sensors could be arranged to view the optically or magnetically visible indicia to trigger an external warning light display on the printer, or send a signal for display on a computer display monitor indicating low ink volume.

It will be realized that the invention presents a simple and inexpensive modification of a prior art spring-reservoir ink reservoir/pen cartridge entirely consistent with the expendable cartridge concept.

I claim:

1. An ink cartridge with an ink supply reservoir comprising:

an external case member:

an internal ink reservoir having a movable portion which moves from a first position when said reservoir is full through an intermediate position when said reservoir is partially empty to a third position when said reservoir is substantially empty;

tab means attached at one end to said movable portion of said internal ink reservoir, for indicating the change in amount of ink in said ink reservoir; and guide means attached to said external case member for defining a passageway to receive said tab means, said guide means including a top surface having a window for displaying visual indicia and a bottom surface for supporting said tab means, and wherein said case member includes a frame member having a recess in one direction and a notch in a second direction normal to said first direction for receiving said tab means, said guide means overlying said tab means as said tab means moves along said recess and said notch.

2. The ink cartridge of claim 1, wherein said external case member includes slot means for allowing said tab means to move therethrough without interference.

3. The ink cartridge of claim 1, wherein said reservoir includes first and second moveable portions and said tab means comprises first and second indicator strips respectively attached at one end to said first and second moveable portions, and said frame member has first and second parallel notches for respectively receiving said first and second indicator strips.

4. The ink cartridge of claim 3, wherein said second indicator strip overlies said first indicator strip, said second indicator strip having a moveable window therein.

5. The ink cartridge of claim 4, wherein said second indicator strip is the same color as said frame member.

6. The ink cartridge of claim 5, wherein said guide means has adhesive on the side thereof which is attached to said case member, and means on said side thereof for preventing said adhesive from inhibiting motion of said indicator strips.

* * * * *